US006338292B1

(12) United States Patent
Reynolds et al.

(10) Patent No.: US 6,338,292 B1
(45) Date of Patent: Jan. 15, 2002

(54) THERMAL AND VISUAL CAMOUFLAGE SYSTEM

(76) Inventors: Robert Fisher Reynolds, 5212 Briar Dr., Houston, TX (US) 77056; Michael Joseph Kinsella, 125 Spyglass Dr., Blue Bell, PA (US) 19422

( * ) Notice: Subject to any disclaimer, the term of this patent is extended or adjusted under 35 U.S.C. 154(b) by 0 days.

(21) Appl. No.: 09/409,482

(22) Filed: Sep. 30, 1999

(51) Int. Cl.[7] ..... F41H 5/00

(52) U.S. Cl. ..... 89/36.02; 89/36.01; 89/36.07; 89/36.08; 89/1.11

(58) Field of Search ..... 89/1.11, 36, 36.02; 342/2, 3, 4, 8, 9, 13; 109/49.5

(56) References Cited

U.S. PATENT DOCUMENTS

| | | | | | |
|---|---|---|---|---|---|
| 3,352,794 | A | * | 11/1967 | Abdo | 252/408.1 |
| 3,561,269 | A | * | 2/1971 | Seitz | 374/162 |
| 3,704,625 | A | * | 12/1972 | Seto et al. | 374/162 |
| 3,781,523 | A | * | 12/1973 | Borom | 219/465.1 |
| 4,105,583 | A | * | 8/1978 | Glover et al. | 436/7 |
| 4,156,033 | A | * | 5/1979 | Bienz | 427/8 |
| 4,278,349 | A | * | 7/1981 | Sander | 356/44 |
| 4,424,990 | A | * | 1/1984 | White et al. | 285/381.2 |
| 4,437,471 | A | * | 3/1984 | Nelson | 600/549 |
| 4,529,633 | A | | 7/1985 | Karlsson | 428/17 |
| 4,560,595 | A | | 12/1985 | Johansson | 428/17 |
| 4,801,133 | A | * | 1/1989 | Engelhardt et al. | 244/121 |
| 5,077,101 | A | | 12/1991 | Conway et al. | 428/17 |
| 5,080,165 | A | * | 1/1992 | Engelhardt et al. | 165/46 |
| 5,124,819 | A | | 6/1992 | Davis | 349/199 |
| 5,165,797 | A | * | 11/1992 | Kuroda et al. | 374/162 |
| 5,307,162 | A | | 4/1994 | Schowengerdt | 348/122 |
| 5,499,597 | A | * | 3/1996 | Kronberg | 116/216 |
| 5,523,757 | A | * | 6/1996 | Resnick | 342/11 |
| 5,547,283 | A | * | 8/1996 | Kronberg | 374/162 |
| 5,734,495 | A | | 3/1998 | Friedman | 359/350 |
| 5,772,328 | A | * | 6/1998 | Kronberg | 374/162 |

* cited by examiner

*Primary Examiner*—Charles T. Jordan
*Assistant Examiner*—Christian M. Best
(74) *Attorney, Agent, or Firm*—Bracewell & Patterson, L.L.P.

(57) ABSTRACT

The invention provides camouflage in both the visual spectrum and the infrared spectrum by emulating the infrared radiation of an object's background and the visible radiation of an object's background, effectively cloaking the object from detection. Initially, the temperature and color of the background against which an object appears is determined. The external surface of the object, or alternatively a shield around the object, is then heated or cooled using thermoelectric modules that convert electrical energy into a temperature gradient. The ability of the modules to be either cooled or heated permits the output of the modules to be altered to match the temperature of an object's background. In combination with these thermocouples, the invention utilizes choleric liquid crystals to alter the visible color of an object. Since the visible color of choleric liquid crystals can be changed with temperature, the heating and cooling ability of the thermocouples can be used to adjust the color of the liquid crystals to match the object's background color.

9 Claims, 1 Drawing Sheet

THERMAL AND VISUAL CAMOUFLAGE SYSTEM

BACKGROUND OF THE INVENTION

1. Field of the Invention

This invention generally relates to surface modification devices and techniques, and more particularly to a background matching camouflage system. Specifically, the invention relates to a passive optical and infrared camouflage system in which a body is heated or cooled to match background emmissivity and in which the body may be simultaneously altered optically to correspond with background colors.

2. Background of the Invention

The art of concealment by altering an object to blend with its physical surroundings and environment, i.e., camouflage, has been practiced for centuries. Initially, it was only necessary to conceal an object from the visible physical surroundings. However, as technology has developed, it has become necessary to conceal an object over multiple bands of the electromagnetic spectrum. Most notably, in addition to visible concealment, it has become necessary to conceal an object's infrared radiation (IR) to prevent thermal detection systems and the like from identifying an object based on its heat signature. Thus, modeling of camouflage effectiveness should consider both the infrared and visible spectrums.

There are three capabilities that must be addressed in a camouflage system: passive surveillance capability, active surveillance capability and high energy weapon capability. Of these, passive surveillance systems utilize electro-optical systems operating in the visible wavelength and infrared wavelength bands. Visual surveillance systems operate in the 0.4 to 0.7 micrometer portion of the electromagnetic spectrum. These systems rely on the visual, that is, that which is recognizable by the human eye. In addition, optical augmentation systems, which range from hand-held binoculars to video display terminals with zoom-in capability, may be utilized to enhance visual detection. In any event, detection mechanisms employed in visual surveillance systems employ color and/or brightness contrast to "identify" targets.

Passive systems which operate in the infrared wavelength bands, the 0.8 to 14 micrometer portion of the electromagnetic spectrum, which include the solar band, the high temperature band and the low temperature band, operate by homing-in on the contrast between the target IR signature and the IR signature of the surrounding environment.

Turning first to visible camouflage, making targets hard to find in the visible light spectrum (wavelength from 400–700 millimicrons) is primarily concerned with the development of ever more effective camouflage patterns and with techniques for characterizing the effectiveness of the camouflage for particular terrain. The techniques in use today largely involve painting, coloring, and/or contour shaping to allow an object to better blend with the surrounding environment. Other than color adaption to the background, these techniques have involved obscuring the contours of an object by covering the object with camouflage material such as nets or leaf cut tarpaulins. Such covering camouflage is good for visual concealment because the outlines of covered objects are disguised and difficult to discern from the surrounding natural environment, provided that the color scheme is harmonized with the surrounding natural environment. Thus, there are manufactured special nets for woodlands, for deserts, and for snow, all of which have very different color schemes.

However, in the visible spectrum, successful camouflage may be limited by factors including the following:

a. Camouflage patterns painted on a conventional surface are unable to change and a fixed camouflage pattern is inappropriate for the variety of backgrounds encountered in nature or otherwise man made.

b. One observer sees a military target against a rocky background while another observer sees the target against a forested background, while a third observer sees the target against a red barn. The current state of the art does not allow the military target to be effectively camouflaged for all these observers simultaneously or in real time.

c. When either the object or the observer moves, the background against which the target is seen changes, reducing the effectiveness of the camouflage pattern.

d. Most camouflage paints, irrespective of their color in the visible spectral range, tend to have high emissivities in the infrared spectral regions, wherein such emmissivities are significantly higher than those of most naturally occurring backgrounds. Therefore, targets painted with such paints can be clearly detected by imaging devices operating in the infrared spectral ranges.

Even the combination of several techniques may not effectively camouflage an object from detection. For example, known camouflage covering material, such as nets, generally have a very open, apertured structure. The proportionate covering of such conventional materials is only about 50–65%. This has been found to be insufficient when surfaces with high emmissivities, such as camouflage paints, are being covered because the high emissivities are still detectable through the covering's apertures. Likewise, such coverings would also be ineffective in masking warm objects against detection by thermal reconnaissance.

Turning now to camouflage in the IR spectrum, finding targets in the IR spectrum utilizes target size and apparent temperature differences between the target and the background (known as $\Delta T$), a summary measure that combines target background physical temperature difference and target background emmissivity difference. Some targets contain highly concentrated heat sources which produce very high localized temperatures. There are also targets that contain a large number of heat sources with distinctive shapes which form easily recognizable patterns. As the contrast sensitivity of solid state detectors improves, it becomes possible to discern, for example, the number of cylinders in a gasoline engine and other subtle distinctions such as a change in fabrication material or perhaps a particular type of seam.

More specifically, many targets have internal heat sources which create a temperature contrast with the natural background which further enhanced the detectability of such targets by means of infrared sensing devices. For example, a tank generates large amounts of heat in the engine compartment and exhaust pipe, as well as from electric generators and motors. When the guns are fired, their barrels become heat sinks. Friction while the tank is moving heats the rims of the drive and the idler wheels and their central bearing portions. The track also becomes heated by friction with the wheels. The bearing area between the turret and tank body can also become heated. Moreover, radiant energy from the sun may be absorbed by the steel shell of a tank during the daytime, and at nighttime such energy reradiates from the shell, providing a clear IR signature against a cool background such as trees or hills. In addition, as mentioned above, the emissivities of paints tend, on average, to be significantly higher than those of most naturally occurring backgrounds. Therefore, a tank painted with camouflage paints can be clearly detected by imaging devices operating in the infrared spectral ranges.

To mask ΔT differences, some IR camouflage prior art techniques have involved the use of subsystems to alter the surface of the object, such as forcing heated or cooled air over an object to match the object's temperature to that of the surrounding environment. Of course, these subsystems themselves often have extraordinary power requirements which generate their own IR signature. Another technique has been to deploy decoy IR sources in an environment to radiate IR signatures equal to that of any specific target. More commonly, however, IR camouflage prior art techniques involve complete covering or shielding of an object with a material cover, such as a tarpaulin, in order to hide an objects IR signature.

Much effort has been expended in the determination of materials to be used to comprise the typical IR camouflage shielding. Typically, shielding provided only by a camouflage material cover will result in heating of the object covered by the material, such that while the structure and contours of such an object cannot be observed visually, the higher temperature of any exposed surface will be vulnerable to detection by IR detection devices. To overcome this effect, double-layered cover structures are utilized, wherein the outer, exposed camouflage material is insulated from a covered source of heat by a layer of insulating material arranged under and spaced apart from the outer material. Of course, the exposed outer camouflage material may still be heated or cooled by external conditions, yielding an IR signature that differs from the surrounding environment.

Thus, the above-described IR camouflage techniques have had only limited success due to factors such as the following:

a. Camouflage material has different heat transfer characteristics from the background resulting in changing apparent temperature differences between the target and the background over a given time interval.

b. Camouflage net material is vented to prevent heat build up, but winds cause the material to move which results in a blinking IR signature that is a clear beacon for detection.

c. One observer seeing an object against a hot background (such as the ground) and a second observer seeing the same object against a cold background (such as the sky), allows for a situation where the current state of the art does not permit the object to simultaneously be made to appear hotter to the first observer and colder to the second observer, and d. When either the object and/or the observer moves, the apparent temperature and spatial pattern of the background against which the surface is seen appears to change, thus clearly revealing the target.

While the prior art teaches the use of surface modification devices and techniques, none have established a basis for a specific apparatus and technique dedicated to the task of resolving the particular problem at hand, namely a camouflage system to prevent both visual and IR detection. The methods and apparatus of the prior art both in the visible and infrared spectral ranges suffer from the drawback that the effective emmissivity of the camouflage material in the infrared ranges cannot readily be closely adapted to that of the surroundings from which the target should be indistinguishable when viewed by infrared detection equipment. Moreover, the thermal "signature" of such targets resulting from internal heat sources such as internal combustion engines, exhaust pipes, electric motors or generators, or transformers, cannot readily be disguised by known methods. What is needed in this instance is a passive, real-time control of: 1) the effective emmissivity (band average and spectral) in the thermal wavelength region, 2) apparent color in the visible wavelength region, and 3) camouflage patterns for both thermal and visible wavelength regions.

The object of the present invention therefore is to provide means and a method for structuring the camouflage surface in such a manner that there is both color adaptation in the visual range and effective emmissivity in the infrared range which can simulate that of virtually any manmade or natural background, and which can further be designed to disguise hot regions of the target which would ordinarily be clearly discernable with infrared detection devices.

SUMMARY OF THE INVENTION

These and other objects are achieved through a system that emulates energy in the visible and infrared electromagnetic spectrum to effectively cloak an object so that the system is difficult to detect either visually or through IR detection means. More specifically, the invention provides camouflage in both the visual spectrum and the infrared spectrum by matching the infrared radiation of an object's background and the visible radiation of the object's background. With respect to infrared radiation matching, the invention involves sensing the temperature of an object's background in order for the object to mimic that temperature. The external surface of the object, or alternatively a shield around the object, is heated or cooled using thermoelectric modules that convert electrical energy into a temperature gradient. When a voltage is applied to these modules one side of the module becomes hot and the other side becomes cold. By controlling the applied voltage across these modules, the temperature of the modules, and hence the temperature of an adjacent surface, can be controlled. As applied to an IR camouflage system, the output temperature of the device can be altered to match the temperature of an object's background such that an IR viewer or detection device is unable to distinguish the object from its surrounding. Thus the object becomes thermally camouflaged.

With respect to visible radiation camouflage, the thermocouples described above are used in conjunction with choleric liquid crystals to alter the visible color of an object. Since the colors of choleric liquid crystals change with temperature, the heating and cooling effect of the thermocouples can be used to control the colors of the liquid crystals. In one embodiment, the liquid crystals are applied either directly to the surface of an object to be camouflaged or to a shield or covering surrounding the object. A color detection device such as a color detection tube is used to determine the color of the object's background. A voltage with a certain magnitude and polarity can then be applied to the thermocouples resulting in a temperature change that alters the color of the liquid crystals to match the color of an object's background.

DETAILED DESCRIPTION OF THE INVENTION

In the detailed description of the invention, like numerals are employed to designate like parts throughout. Various items of equipment, such as fasteners, fittings, etc. may be omitted to simplify the description. However, those skilled in the art will realize that such conventional equipment can be employed as desired.

Generally, the invention operates in two modes to camouflage a heat source or other object. The first mode matches the apparent infrared signature of the heat source with the infrared signature of the heat source's background or surrounding environment. This is accomplished by constructing a shield around the heat source and using a plurality of thermocouples to heat or cool the shield until it's infrared signature matches that of the background, effectively masking the infrared signature of the heat source. The second mode matches the visible color of the heat source with the visible color of the heat source's background or surrounding environment. Specifically, the color of the shield surrounding the heat source is altered to be substantially similar to the surrounding natural environment.

Figure 1:
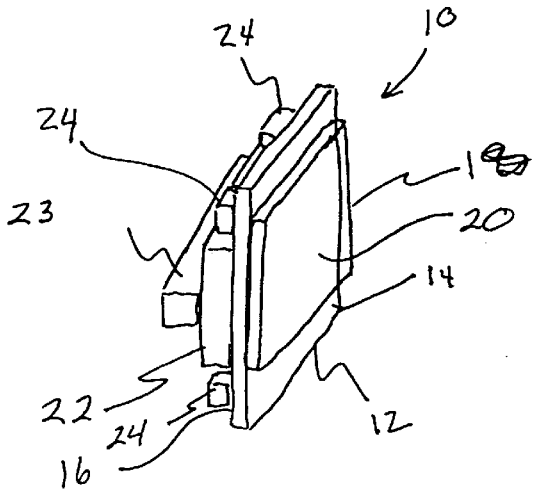
FIG. 1 is a cut-away perspective view of the invention illustrating the positioning of the choleric liquid crystals and thermocouple with respect to one another.

With reference to FIG. 1, a cut-away side view representative of a camouflage system 10 contemplated by the invention is shown. System 10 includes a shield 12 having a first side 14 and a second side 16. Attached to the first side 14 of shield 12 is thermocromatic material 20. Attached to the second side 16 of shield 12 is a plurality of thermocouples or thermoelectric modules 22. Each module 22 is provided with a heat sink 23. In addition, attached to shield 12 adjacent each module 22 is at least one, but preferably a plurality of temperature sensors 24 used to monitor the temperature profile of shield 12. In the preferred embodiment, shield 12 a conductive material such as a thin metallic sheet. Although various types of such conductive material may be utilized, a thin sheet of aluminum has been found to be highly desirable since such a sheet provides rigidity and strength, but can quickly reach a temperature equilibrium when subject to a change in temperature, resulting in an even temperature distribution across the surface of the sheet.

Figure 2:
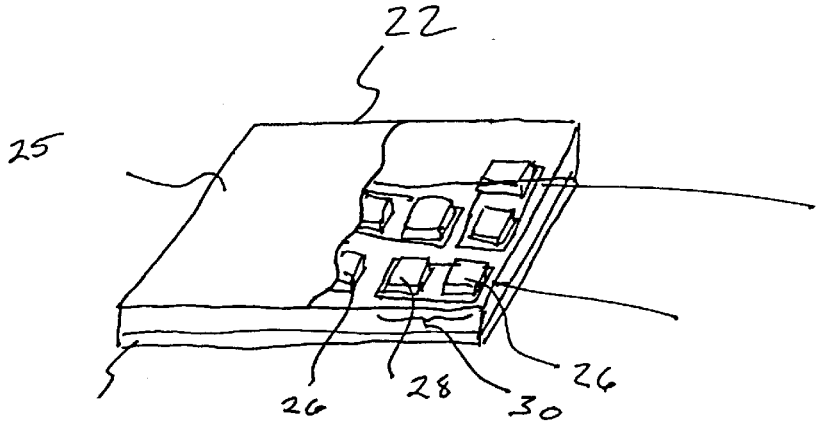
FIG. 2 is a cut-away perspective view of a cooling/heating thermocouple used to practice the invention.

As illustrated in FIG. 2, each thermoelectric (TE) module 22 is a solid-state devices that can convert electrical energy into a temperature gradient, known as the "Peltier effect", or can convert a temperature gradient into electric energy, known as the "Seebeck effect." Most commonly, thermoelectric modules such as these utilize the Seeback effect to generate electric energy from a temperature gradient. The instant invention, however, utilizes the Peltier effect in these modules for temperature control rather than power generation, such that the modules can heat or cool shield 12 as desired.

Thermoelectric modules such as module 22 are typically composed of a plurality of sets of P-type and N-type Bismuth Telluride elements alternatingly arranged in series and sandwiched between two ceramic substrates 25. Each set of elements is comprised of a P-type element 26 and an N-type element 28 that are electrically connected to one another to form a couple 30. Each couple 30 is electrically connected to an adjacent couple 30 so that the P-type element 26 of one couple is in electrical contact with the N-type element 28 of the adjacent couple. The effect is that the P-type and N-type elements are also arranged thermally in parallel between the ceramics. Although both types of elements are formed of similar alloy material, the various types of elements have different free electron densities at the same temperature. Generally, the P-type elements are comprised of material having a deficiency of electrons while the N-type elements are comprised of material having an excess of electrons. As current flows through couple 30, couple 30 attempts to establish equilibrium between its P-type and N-type elements. The P-type element is treated as a hot junction requiring cooling, while the N-type element is treated as a cool junction requiring heating. Since the P-type and N-type elements are actually the same temperature prior to current flow, a current flow through couple 30 results in heating of the N-type element and cooling of the P-type element. The overall effect on the module is that one ceramic side 25 of module 22 becomes hotter and the opposite ceramic side 25 of module 22 becomes colder with current flow. The direction of the current though couple 30 effects cooling and heating. Specifically, a reverse in the polarity of couple 30, and hence the overall module, results in a switch between the cold and hot sides of module 22. Advanced Thermoelectric Products sells thermoelectric modules that could be used in the practice of the invention.

As mentioned above, each module 22 is provided with a heat sink 23 to prevent the module 22 from overheating. Modules 22 tend to be sensitive to high temperatures, such that if they become too hot, the module components may fail. More importantly, heat sink 23 permits module 22 to reach a higher temperature differential between its hot ceramic side and cool ceramic side. In practice, the invention has been found to be operable within a range from approximately 32° F. to 160° F., although such range may differ with various types of modules and materials. Modules 22 are spaced far enough apart on shield 12 to permit temperature sensors 24 to be distributed between adjacent modules 22. When it is desired to raise the temperature of shield 22, the ceramic substrate 25 in contact with shield 22 is caused to be heated as described above. Since shield 22 itself acts as a heat sink, the heat energy generated by module 22 is rapidly transferred to shield 22 and uniformly spread across the surface of shield 22. Of course, when shield 22 is to be cooled, heat sink 23 is utilized to permit module 22 to rapidly create a temperature differential between the colder ceramic substrate in contact with shield 22 and the warmer ceramic substrate to which heat sink 23 is attached.

As mentioned above, it is most desirable to utilize a plurality of temperature sensors 24 distributed over surface 16 of shield 12 interspersed between modules 22. In the preferred embodiment, the average temperature of those sensors 24 directly adjacent a module 22 is used to determine the performance of that particular module.

Thermocromatic material 20 is most preferably formed of liquid crystals, such as choleric liquid crystals, contained in a polyester envelope or the like to protect the crystals from the environment. Such crystals exhibit different colors at different temperatures. In the preferred embodiment, thermocromatic material 20 is selected to have the following visible color characteristics based on a particular material temperature: red at approximately 20° C., green at approximately 34–35° C., and blue at approximately 46° C. Of course, additional colors may be utilized without departing from the spirit of the invention. However, it has been found that by utilizing liquid crystals able to exhibit the colors of red, green and blue, most naturally occurring colors can be mimicked. In any event, the temperature applied to thermocromatic material 20, and hence its visible color, are regulated by way of modules 22. Specifically, since material 20 is attached to shield 12 and the temperature of shield 12 can be controlled utilizing modules 22, the temperature applied to material 20 and thus its visible color can be controlled by modules 22. Utilizing steps described in more detail below, module 22 is used to apply the temperature necessary to achieve a particular color in material 20. In practice, the response time of the liquid crystals to a change in temperature has been found to be only several seconds when shield 12 has the characteristics described herein.

Figure 3:
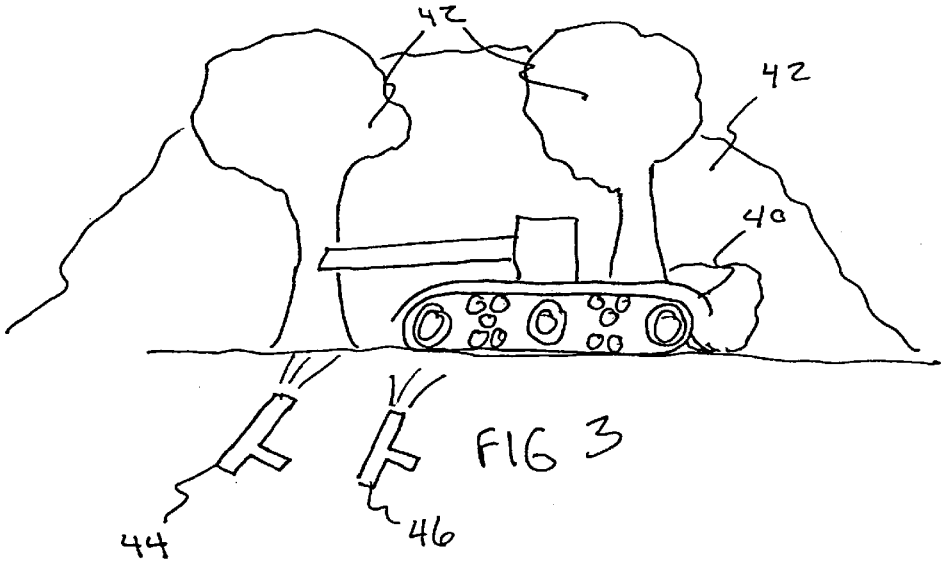
FIG. 3 is a perspective view illustrating a practical method for practicing the invention.

With reference to FIG. 3, an object 40, such as a tank, is shown against a background environment 42. In practice, camouflage system 10 would be deployed over the surface or otherwise around object 40. Camouflage system 10 is disposed to operate in two modes. The first mode of system 10 matches the infrared radiation of system 10 with background infrared radiation, while the second mode of system 10 matches the visible radiation or external color of system 10 with background infrared radiation. Depending on the particular environment, only a single mode of operation may be necessary under certain conditions. For example, a body's temperature or infrared radiation signature is commonly more detectable at nighttime as the surrounding environment cools. Thus, although darkness renders visible detection more difficult, an infrared signature is more distinguishable at night time and would be the primary focus of a night time camouflage system. The opposite is also true. During the daytime, an object often is more likely to be detected through visual surveillance rather than infrared surveillance such that visual camouflage becomes the primary focus during hours of visible light.

In any event, the first step in practice of the invention is to detect infrared and visible characteristics of an object's background or environment 42, whether such background comprises a single background element, i.e. a tree, or multiple background elements, i.e., trees, hills, rocks, etc. With respect to the first mode, the background 42 infrared radiation is detected using any standard means such as heat tracer gun 44. One particularly effective gun 44 is the 3K Heat Tracer Gun which is a thermal radiation sensing device that determines the temperature of a surface by measuring the wavelengths of the surface's thermal radiation. With respect to the second mode, the visible radiation of the background 42 is determined by analyzing the wavelengths of visible color that are similar to the colors that can be generated by the liquid crystals. Any standard color detection device 46 may be used. Typically, such device utilizes photodiodes with various color filters to accomplish this. For example, if liquid crystals of red, green and blue are utilized in the practice of camouflage system 10, then the background visible wavelengths of red, green and blue would be analyzed to determine the background color. Photodiodes with color specific filters can be used to identify such background colors. Gun 44 and device 46 may be mounted on the object to be camouflaged.

Generally, once background temperature and background irradiation are know, this information is correlated and the output temperature of modules 22 are adjusted, based on the correlation, to alter the temperatures and color of camouflage system 10. More specifically, the ratio of the presence of red, green and blue in the background are determined. This ratio is representative of the actual color of the background. This ratio is then compared to the preset standards for thermocromatic material 20 to determine which preset color is closest to the actual color of the background. Once the appropriate ratios are determined, a voltage is then applied to the thermocouples to heat or cool camouflage system 10 as desired. As the temperature of camouflage system 10 adjusts based on this voltage, the color of the system is altered as the choleric liquid crystals respond to the temperature change.

In another embodiment, if both visible and infrared radiation are being mimicked, i.e., dual mode camouflage, then an additional ratio of the background color to the background temperature is created and the color responsiveness of camouflage system 10 is adjusted so that when the temperature of the system is adjusted to match the background temperature, the color of the system simultaneously adjusts to match the background color. Of course, if the system is operating in only a single mode, this additional correlation is not necessary.

The present invention provides a dual mode system that permits masking in both the visible and infrared energy spectrums. The system can operate to mask either an object's infrared signature, the object's visible appearance, or both. The system permits both heating and cooling to accomplish such camouflage. One advantage of such a system is that all the thermocouples can be individually controlled such that an object being camouflaged can have different temperatures and colors along its surface. For example, in FIG. 3, the portions of the tank sitting in front of foliage having a first temperature and color can be varied from the portions of the tank sitting in front of a rock having a different temperature and color.

While certain features and embodiments of the invention have been described in detail herein, it will be readily understood that the invention encompasses all modifications and enhancements within the scope and spirit of the following claims.

What is claimed is:

1. A camouflage system comprising:

a. at least one thermocouple;

b. at least one thermocromatic element capable of changing color in response to said thermocouple;

c. a conductive shield having a first side and a second side, wherein said thermocromatic element is attached to the first side and said thermocouple is attached to the second side of said shield;

d. at least one temperature sensor disposed on the second side of said shield adjacent said thermocouple; and e. at least one heat sink disposed at the second side of said shield adjacent said thermocouple.

2. The camouflage system of claim 1 wherein said thermocouple has a first outer surface and a second outer surface, and wherein said first surface of said thermocouple can be cooled and the second surface of said thermocouple can simultaneously be heated upon application of a current to said thermocouple.

3. The camouflage system of claim 1 wherein said thermocromatic element comprises choleric liquid crystals.

4. The camouflage system of claim 1 wherein said shield is an aluminum sheet.

5. A method for camouflaging an object to blend with its background, the method comprising:

a. applying at least one thermocromatic element to an object;

b. determining the color of the object's background;

c. adjusting the color of the thermocromatic element to mimic the determined background color;

d. applying at least one thermocouple to an object;

e. determining the infrared radiation of the objects background;

f. heating or cooling the thermocouple to mimic the determined background temperature.

6. A method for camouflaging an object to blend with its background, the method comprising:

a. applying a plurality thermocromatic elements to a first external side of a conductive cover;

b. applying a plurality of thermocouples to a second side of said cover;

c. determining the color of the object's background;

d. determining the presence of red, green and blue in said background color;

e. creating a ratio based on the presence of red, green and blue in said background color;

f. determining the infrared radiation of the object's background;

g. correlating the background temperature to background color;

h. adjusting the temperature of the thermocromatic; and i. adjusting the color of the thermocromatic elements to mimic the determined background color.

7. The method of claim 6 further comprising the step of comparing the ratio of red, green, and blue to preset colors achievable by said thermocromatic elements to determine which preset color is closest to said naturally occurring color represented by said ratio.

8. The method of claim 6, wherein said step of adjusting the temperature is accomplished by applying a voltage to said thermocouple to heat or cool said thermocouple.

9. The method of claim 6, wherein said step of adjusting said color of the thermocromatic elements is accomplished by applying a voltage to said thermocouple to heat or cool said thermocouples.

* * * * *